United States Patent [19]

Glaser

[11] 4,193,362

[45] Mar. 18, 1980

[54] DEVICE FOR LOCKING THE NEEDLE BAR OF A SEWING MACHINE IN ONE OF ITS END POSITIONS

[75] Inventor: Fritz Glaser, Liestal, Switzerland

[73] Assignee: Fritz Gegauf Aktiengesellschaft, Bernina-Nahmaschienfabrik, Steckborn, Switzerland

[21] Appl. No.: 971,763

[22] Filed: Dec. 21, 1978

[30] Foreign Application Priority Data

Dec. 27, 1977 [CH] Switzerland ..... 16074/77

[51] Int. Cl.[2] ..... D05B 69/22

[52] U.S. Cl. ..... 112/275

[58] Field of Search ..... 112/275, 274, 271, 277, 112/220, 67, 87, 121.11; 318/467, 266

[56] References Cited

U.S. PATENT DOCUMENTS

| | | | |
|---|---|---|---|
| 3,174,450 | 3/1965 | Becker et al. | 112/275 |
| 3,636,902 | 1/1972 | Matsubara et al. | 112/275 |
| 3,788,250 | 1/1974 | Soeda | 112/275 |
| 3,804,043 | 4/1974 | Benson et al. | 112/275 |
| 4,013,933 | 3/1977 | Dohi et al. | 318/467 |

*Primary Examiner*—H. Hampton Hunter
*Attorney, Agent, or Firm*—Ladas, Parry, Von Gehr, Goldsmith & Deschamps

[57] ABSTRACT

A device for a sewing machine for making functional and ornamental stitches permits locking the needle bar according to signals that are given from a pulse transmitter, which monitors the rotational position of the top shaft, to a control system which actuates the drive motor of the sewing machine in coincidence with a foot starter. The sewing machine possesses a manually adjustable stitch selector and a device controlled by the needle bar drive for monitoring the relative position of the end of an ornamental stitch pattern. With both the stitch selector and the monitor device are operatively connected respective reversing switches adapted to be brought each into one of two change-over positions. The two reversing switches are so connected that in the "ornamental stitch" position of the stitch selector the reversing switch of the monitor device in one position relays the position signals of the lower needle bar position to the control system and in the other position closes a break contact of an indicator circuit which signals the approximation of the end of an ornamental stitch pattern. If during the signaling operation the foot starter is released, the control system locks the needle bar in its lower end position after a certain number of stitches. If the stitch selector is in its "functional stitch" position, then upon release of the foot starter, the control system locks the needle bar in its upper final position.

1 Claim, 1 Drawing Figure

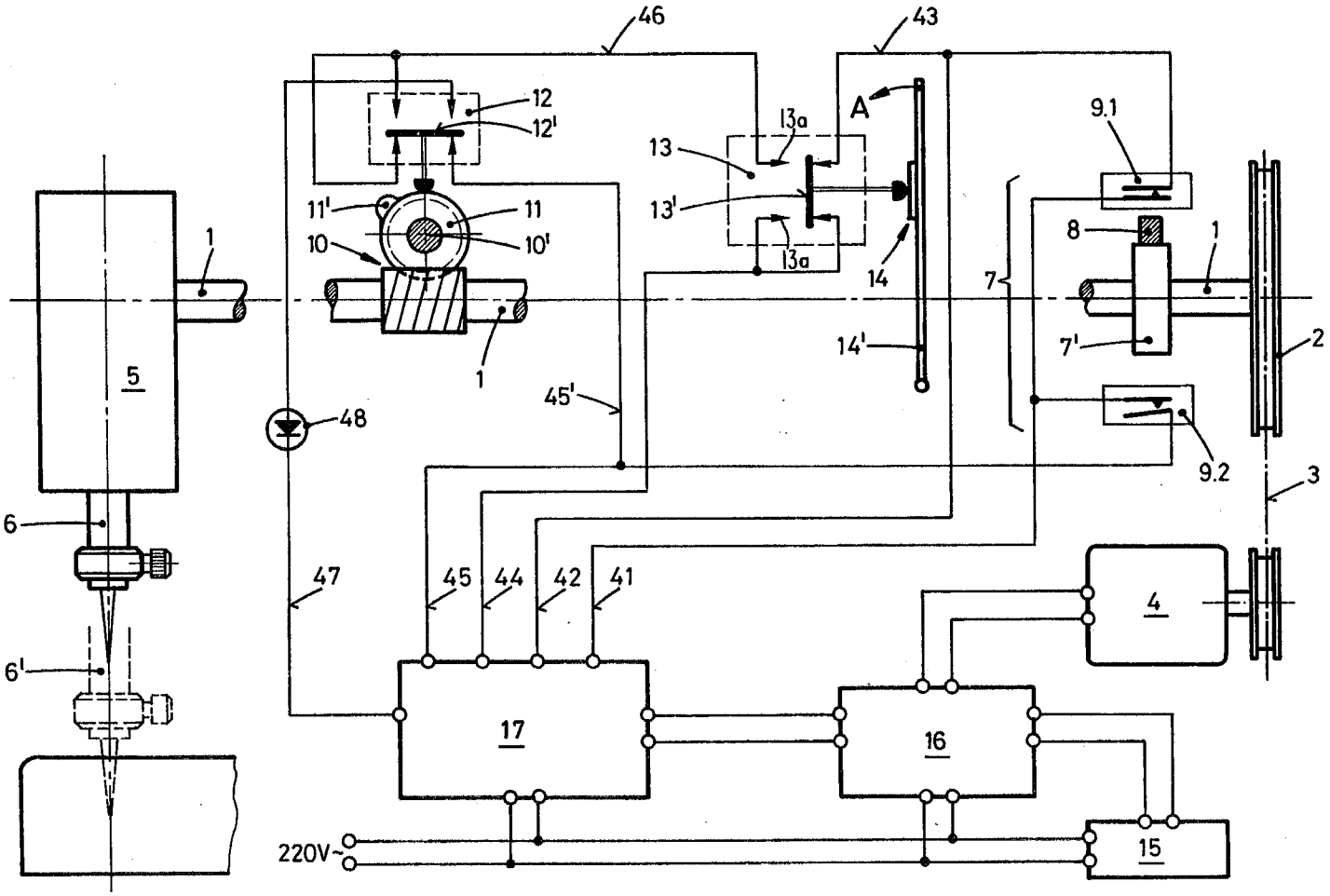
2
3
1
9.2
9.1
8
7'
4
15
7
16
43
A
14
14'
13a
13a
13
13'
46
41
42
44
45
45'
17
12
12'
11
10'
1
11'
10
48
47
220V~
1
5
6
6'

DEVICE FOR LOCKING THE NEEDLE BAR OF A SEWING MACHINE IN ONE OF ITS END POSITIONS

This invention relates to a device for locking the needle bar of a sewing machine in one of its end positions.

It is known already to equip sewing machines with devices for locking the needle bar in one of its end positions, preferably the upper end position. However, most sewing machines having such devices are industrial sewing machines provided with braking or locking means that operate only electrically or electromechanically. But household machines have hitherto been equipped at best with semiautomatic stopping devices that can be manually released.

The problem to be solved by the instant invention consists in providing a locking device for the needle bar that is preferably but not exclusively suited to household sewing machines and that works without auxiliary intervention of the user.

According to the present invention there is provided a device for locking the needle bar of a motor-driven sewing machine for making functional and ornamental stitches in its upper or lower end position, comprising first and second pulse transmitters for respectively signalling the upper and the lower end positions of the needle bar, a control system for actuating the drive motor of the sewing machine, means for selecting the kind of functional or ornamental stitch to be made by the sewing machine, and means mechanically controlled by the needle bar drive for monitoring the position of the end of an ornamental stitch pattern in relation to a point of reference of the ornamental stitch pattern, the device comprising a first reversing switch having a movable contact member which is adapted to be brought into either of two switch positions by a control element of said means for monitoring the ornamental stitch pattern in order to transmit, in the first switch position, the position signal of the second pulse transmitter to said control system and, in the second switch position, to close a break contact in the electric circuit for actuating an indicator means adapted to signal the approach of the end of an ornamental stitch pattern, and the device also comprising a second reversing switch having a movable contact member which is adapted to be brought into either of two switch positions by a control element of the stitch-selecting means, the first of said switch positions being assigned to the functional stitch and the second to the kinds of ornamental stitch in order to transmit the position signal of the first pulse transmitter to said control system in the first switch position, and in order to apply the supply voltage to the break contact in said first reversing switch in the second switch position for actuating said indicator means when said stitch-selecting means is connected for making ornamental stitches.

In the operation of a sewing machine equipped with such a device embodying the invention, for locking the needle bar in one of its end positions, it is possible to eliminate to a great extent many of the formerly widespread errors of manipulation made buy persons who had not much practice.

In most of the sewing tasks that are normally required in the household, it is desirable or necessary that after terminating a seam the needle be outside the article being sewn so that the latter can be withdrawn unhindered under the press foot. With a device embodying to the invention the needle does not have to be raised manually. Buttonholes can be sewn uninterruptedly by manual or semiautomatic connection according to the correct cycle without rotating the handwheel.

When sewing ornamental stitch designs, the needle is stuck in the article being sewn at its low end position. Thereby the article being sewn can be precisely shifted without moving the handwheel and easily turned around for sewing patterns. In the operation with adjusted seam length, the machine sews the seam automatically on the preselected length. Thus, a seamstress can completely concentrate on the sewing work.

An example of the invention is described below with reference to the drawing that shows a functional diagram, partly in block form, of the device according to the invention, wherein the control members connected with parts of the sewing machine are diagrammatically represented.

In the drawing, 1 designates the top shaft of the sewing machine at one end of which top shaft is carried a drive pulley 2 coupled via a drive belt 3 with the drive pulley of the sewing machine motor 4. At the other end of said top shaft 1 is diagrammatically shown the needle bar gearing 5 at the lower side of which the needle bar is represented with solid lines in its upper end position 6 and with dotted lines in its lower end position 6'. As indicator 7 of the shaft rotating position has a disc tightly secured to the top shaft 1 and rotating with the shaft or a supporting arm 7' that carries a peripherally disposed permanent magnet element 8. The permanent magnet element 8 serves to actuate two stationary reed switches 9.1, 9.2 of the indicator of rotating position. The reed switch 9.1 is actuated (closed) by the permanent magnet 8 when the needle bar is in the upper position while the reed switch 9.2 closes when the needle bar is in the lower position.

On the top shaft 1 is likewise supported a cam-plate drive mechanism 10 which is part of the ornamental stitch disc drive of the sewing machine and carries on a driven shaft 10' a cam plate 11 which is rotatably adjustable in relation to the shaft 10'. The cams 11' of the cam plate actuate a first reversing switch 12. The purpose and mode of operation of the reversing switch fed according to the switch position of the stitch-programming means of the sewing machine will be described later. Likewise controlled by the stitch programming means is a second reversing switch 13 which is actuated according to the position of a stich-selecting means 14, and which upon rotation of the selecting lever 14' in the direction of arrow A brings the contact plate 13' into contact with the working contacts **13*a*. Let it be observed here that FIG. 1 shows only those parts of the device 14** and of the actuating elements thereof that are significant within the scope of the instant explanation.

The drawing further shows the power supply of the machine operation and control thereof comprising a starter pedal 15, a motor control circuit 16 and a logic switch 17 that controls the locking of the needle bar. The last three mentioned parts of the device are shown in block form and contain known devices for carrying out the operation they perform.

The diagram shown is biased on the assumption that the sewing machine is optionally adjustable to different shapes of stitch, as is particularly the case in modern household sewing machines. In the illustrated position of the selecting lever 14' of a stitch-selecting device 14, not shown in detail, the reversing switch 13 is in the position in which the sewing machine is connected for making functional stitches and the ornamental stitch mechanism is not activated. The reversing contacts to the right of the contact plate 13' are interconnected via the latter, and there is ready an electric circuit that starting from the logic switch 17 leads back, via a wire 41, to the reed switch 9.1 and from there on the side, via a wire 42, directly back to the logic switch 17 and on the other, via a wire 43, to the closed normal contacts in the reversing switch 13, and a wire 44, again to the logic switch 17. The reversing switch 12 over the cam-plate drive mechanism (ornamental stitch monitor) is not included in the circuit here.

Now, if while drive voltage is supplied the starting pedal 15 is pressed, the motor 4 is started by the motor control switch 16 and the speed of the motor is adjusted to a desired value of a minimum of about 120 stitches per minute. As the same time, the rotary part of the indicator 7 of the shaft rotating position rotates also on the top shaft 1 and each time the permanent magnet 8 runs past one of the reed switches 9.1, 9.2, the respective contact elements close. The alternating voltage pulses of the two reed switches produced thereby are led back via the wires 42 and 45 to the logic circuit 17. This circuit establishes, on the basis of the pulse frequency, whether the top shaft 1 is being operated manually (by a flywheel not shown) or by the motor 4. If the top shaft 1 rotates during at least two revolutions with the minimum motor speed or more, this mode of operation is stored in the logic circuit 17.

If the starting pedal 15 is now released, then the motor 4 is disconnected by the control switch 16 and the machine stops. When during a certain short period of time, such as about 200 msec., no more pulses of the reed switches 9.1, 9.2 reach the logic circuit, it is assumed that the top shaft 1 has practically come to rest. This condition is likewise taken care of by the logic circuit 17 whereupon the latter again feeds for a short time the motor 4 via the motor control circuit 16 until it receives another pulse from the reed switch 9.1 via the wires 42,44. The pulse indicates that the needle bar 6 is now in the region of its upper end position. The motor 4 is immediately stopped and the needle bar 6 remains in the region of its upper end position. By again pressing down the starting pedal 15, the arrest of the motor can be terminated by the logic circuit and another sewing operation be initiated. The period of time between the arrest of the top shaft 1 and the stoppage of the needle bar 6 is short enough to ensure that the user does not assume that the sewing operation has entirely terminated and does not await the return motion (slow in itself) of the needle bar before carrying out subsequent, at best dangerous, manipulations in the area of the needle bar or other parts of the sewing machine that move during the sewing operation.

For sewing ornamental stitches, the stitch-selecting lever 14 is shifted in the direction of arrow A (or in an operatively equivalent direction) and thereby the external circuit section of the logic circuit 17 is changed over to the left contact set in the reversing switch 13. Thereby the reversing switch 12 is also included in this circuit section. Just as in the reversing switch 13, the reversing switch 12 has a resting and a working contact set, the latter being adapted to be brought to its closing position by a control member, not shown, controlled by the cam 11' of the cam plate 11. The resting contact set (shown below horizontally) connects a branch 45' of the wire 45 to a wire 46 that leads to a contact of the now closed working contact set in the reversing switch 13 by which last mentioned wire 46 is connected with the wire 44 leading to the logic circuit 17. As already said, the reversing switch 12 is fed from the reversing switch 13. In its fed condition it is possible to cause a later described automatic disconnection of the machine after producing a certain ornamental stitch pattern, whereas in its unfed condition the ornamental stitches can be sewn in the same manner described in relation to the functional stitches with the difference that here the needle bar is stopped in its lower end position 6' (instead of in the upper end position).

If, as described above for making functional stitches, the starting pedal 15 is now pressed during supply of drive current, the motor 4 is started via the motor control circuit 16 and the speed thereof is again adjusted to a desired value. The reed switches 9.1, 9.2 in the indicator 7 of the shaft rotating position work in the manner described already and alternately supply corresponding pulses via the wires 42 and 45 back to the logic circuit 17. The pulses are processed there in the manner described already and the processing result is stored.

If the starting pedal 15 is now released, the motor 4 is disconnected via the control circuit 16 and the machine stops as described already. When no more pulses of the reed switches 9.1, 9.2 reach the logic circuit 17, it is again assumed that the top shaft 1 has stopped. After this condition is established, the motor 4 is again fed for a short time via the motor control circuit 16 until the logic circuit receives the next pulses from the reed switch 9.2. This pulse that goes back to the logic circuit 17 via the wire 45 indicates that the needle bar is now in the region of its lower end position 6'. The motor 4 is stopped and the needle bar remains in the region of its lower final position 6' with the needle stuck in. The fabric can thus revolve about the needle and thereby can be easily oriented, for instance, for sewing new designs. By again pressing down the starting pedal 15, the stoppage of the motor can be ended by the logic circuit 17 and another ornamental stitch sewing operation can be initiated.

Shortly before terminating an ornamental stitch pattern, that is, about 5 stitches before, the cam 11' opens the contact pair 12' and closes the working contacts horizontally shown above. The closing of said working contacts causes a light-emitting diode 48 which is connected by a wire 47 to respond and optically show the prompt termination of the ornamental stitch pattern. An adjusting scale (not shown) for the cam plate 11 is adjusted in relation to the cam 11' in a manner such that shortly after making four of the last five stitches, that is, when the cam 11' has run over the actuating member of the reversing switch 12 and the contact plate 12' returns to its normal position, the top shaft 1 is still further rotated through an angle corresponding to about $\frac{3}{4}$ of the length of one stitch.

In case during the lighting of the light diode 48 the starting pedal 15 is a completely released, the logic circuit 17 controls the motor 4 via the motor control logic 16 so that when the last stitch of the ornamental stitch pattern is made, the needle bar, as described before, is automatically passed, by again starting the motor for a short time, to its low end position, the needle remaining stuck in the article being sewn in the last stitch. If during the lighting of the light diode 48 the starting pedal is not released, for example, when an additional ornamental stitch pattern is to be made, then the machine is allowed to run until reaching the next monitored pattern end.

I claim:

1. A device for locking the needle bar of a motor-driven sewing machine for making functional and ornamental stitches in its upper or lower end position, comprising first and second pulse transmitters for respectively signaling the upper and the lower end positions of the needle bar, a control system for actuating the drive motor of the sewing machine, means for selecting the kind of functional or ornamental stitch to be made by the sewing machine, and means mechanically controlled by the needle bar drive for monitoring the position of the end of an ornamental stitch pattern in relation to a point of reference of the ornamental stitch pattern, the device comprising a first reversing switch having a movable contact member which is adapted to be brought into either of two switch positions by a control element of said means for monitoring the ornamental stitch pattern in order to transmit, in the first switch position, the position signal of the second pulse transmitter to said control system and, in the second switch position, to close a break contact in the electric circuit for actuating an indicator means adapted to signal the approach of the end of an ornamental stitch pattern, and the device also comprising a second reversing switch having a movable contact member which is adapted to be brought into either of two switch positions by a control element of the stitch-selecting means, the first of said switch positions being assigned to the functional stitch and the second to the kinds of ornamental stitch in order to transmit the position signal of the first pulse transmitter to said control system in the first switch position, and in order to apply the supply voltage to the break contact in said first reversing switch in the second switch position for actuating said indicator means when said stitch-selecting means is connected for making ornamental stitches.

* * * * *